United States Patent [19]

Harris

[11] Patent Number: 4,959,975

[45] Date of Patent: Oct. 2, 1990

[54] HEAT PUMP SYSTEM

[75] Inventor: Kenneth J. Harris, Chardon, Ohio

[73] Assignee: Conserve, Inc., Erie, Pa.

[21] Appl. No.: 50,704

[22] Filed: May 14, 1987

[51] Int. Cl.[5] ..... F25B 27/00

[52] U.S. Cl. ..... 62/238.6; 62/506; 62/508; 62/509

[58] Field of Search ..... 62/183, 238.6, 506, 62/508, 509

[56] References Cited

U.S. PATENT DOCUMENTS

| | | | |
|---|---|---|---|
| 2,516,094 | 7/1950 | Ruff | 62/238.6 X |
| 2,575,325 | 11/1951 | Ambrose et al. | 62/238.6 X |
| 2,696,085 | 12/1954 | Ruff | 62/238.6 X |
| 2,802,342 | 8/1957 | Gray | 62/238.6 X |
| 3,545,228 | 12/1970 | Dinger et al. | 62/506 |
| 3,908,393 | 9/1975 | Eubank | 62/506 |
| 3,996,764 | 12/1976 | Gilmer et al. | 62/279 |
| 4,365,483 | 12/1982 | Binger | 62/506 X |
| 4,373,346 | 2/1983 | Hebert et al. | 62/238.6 X |
| 4,399,664 | 8/1983 | Derosier | 62/238.6 X |
| 4,399,669 | 8/1983 | Jacobs | 62/508 X |
| 4,423,602 | 1/1984 | Venable | 62/238.6 |
| 4,651,539 | 3/1987 | Coloka | 62/504 |
| 4,683,726 | 8/1987 | Barron | 62/509 X |

FOREIGN PATENT DOCUMENTS 0041352 9/1981 European Pat. Off. .

*Primary Examiner*—Lloyd L. King

*Attorney, Agent, or Firm*—Renner, Otto, Boisselle & Sklar

[57] ABSTRACT

A heat pump installation including a condenser, a motor-compressor, an evaporator, and a subcooler to subcool the refrigerant flowing from the condenser before it enters the evaporator. The motor-compressor is mostly immersed in a static liquid contained within an inner tank. Preferably, the static liquid contains a top layer of oil to prevent evaporation. The static liquid helps to ensure the cool and quiet operation of the motor-compressor. Surrounding the inner tank is an outer tank which provides a cylindrical chamber wherein circulating liquid such as water flows. Immersed within the circulating water is the condenser. The circulating water withdraws heat from the inner tank and the condenser. The subcooler includes a housing which contains and directs the flow of the circulating water before it enters the cylindrical chamber. Immersed within the circulating water of the subcooler housing is a refrigerant subcooling coil. The circulating water serves to subcool the refrigerant flowing in the subcooling coil before the refrigerant enters the evaporator thereby improving the efficiency of the heat pump system. If the invention is employed to heat potable water a separate heating coil is provided which is immersed in the circulating water contained in the cylindrical chamber. The invention further provides a unique condenser and method of producing the same.

4 Claims, 8 Drawing Sheets

HEAT PUMP SYSTEM

This invention relates to heat pumps. More particularly, this invention relates to a heat pump system which exhibits improved operating efficiencies, capacity, and economics of construction.

BACKGROUND

The prior art provides various heat pump systems. An example of a prior art heat pump system may be found in published Harris European Patent Application No. 81302302.5. Such heat pump systems may be utilized to provide both hot and cold conditioned fluid. Although heat pump systems have experienced considerable commercial acceptability, there is a continual ongoing effort to improve the efficiencies of such systems.

The present invention provides a heat pump system which displays improved efficiencies, capacities and economics of construction and maintenance as compared to prior art systems.

SUMMARY OF THE INVENTION

The present invention provides a heat pump system or installation which exhibits improved operating efficiencies, operating characteristics and economics of construction and maintenance. In one preferred embodiment a heat pump system made in accordance with the present invention includes a compressor-condenser unit, a subcooler, and an evaporator.

The compressor-condenser unit includes an inner tank and an outer tank. Located within the inner tank is a motor-compressor mostly immersed within a liquid which remains static and does not circulate. The electrical connections at the top of the motor-compressor are not immersed. The outer tank surrounds the inner tank and provides a chamber wherein a circulating liquid such as water flows. Immersed within the circulating water is the condenser. The circulating water withdraws heat from the condenser and also the inner tank. Also immersed within the circulating water contained within the outer tank may be a heat exchanger coil for heating potable water. Both the heat exchanger coil and the condenser may include a plurality of fins to enhance the transfer of heat.

The subcooler includes a tank which contains the circulating water before it enters the outer tank and a refrigerant subcooling coil is immersed therein. The subcooler serves to subcool the liquid refrigerant flowing from the condenser before it enters the evaporator. Preferably, the subcooling coil comprises a refrigerant input tube which branches into a pair of tubes connected in parallel. By providing a pair of tubes there is twice the surface area for the same mass flow that would be provided with a single tube having twice the diameter. This increase in surface area enhances the transfer of heat between the refrigerant and the circulating water. In one preferred embodiment of the subcooler the pair of parallel tubes are formed into a helical shape and extend throughout the length of the subcooler and are joined at one common end to a tube having a straight portion which extends through the center of the helix formed by the tubes connected in parallel. The straight portion includes a plurality of fins to enhance the transfer of heat from the refrigerant flowing in the straight tube to the circulating water.

Generally, for example in a typical system, where the utilization of the subcooler results in a 9° F. subcooling effect upon the refrigerant, approximately a 4.2% increase in efficiency of the system is experienced. The standard cycle for considering this effect assumes that the liquid is subcooled 9° F. from 86° F. to 77° F. In calculating the effect the heat content of saturated liquid refrigerant at 77° F. is used, and subcooling as much as 110° F. may be achieved as hereinafter described.

Preferably, the motor-compressor utilizes a rotary pump. A rotary pump has been found to provide various operational advantages over conventional reciprocating pumps.

Also, in a preferred form the condenser coil may be fabricated from parallel straight finned coils of two different lengths, which when circularized and positioned in the outer tank will be of the same circumferential extent.

The foregoing and other features of the invention are hereinafter more fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF PREFERRED EMBODIMENTS

A heat pump system made in accordance with the present invention may be utilized to produce heated and cooled air, water, or other like conditioned fluid.

Figure 1:
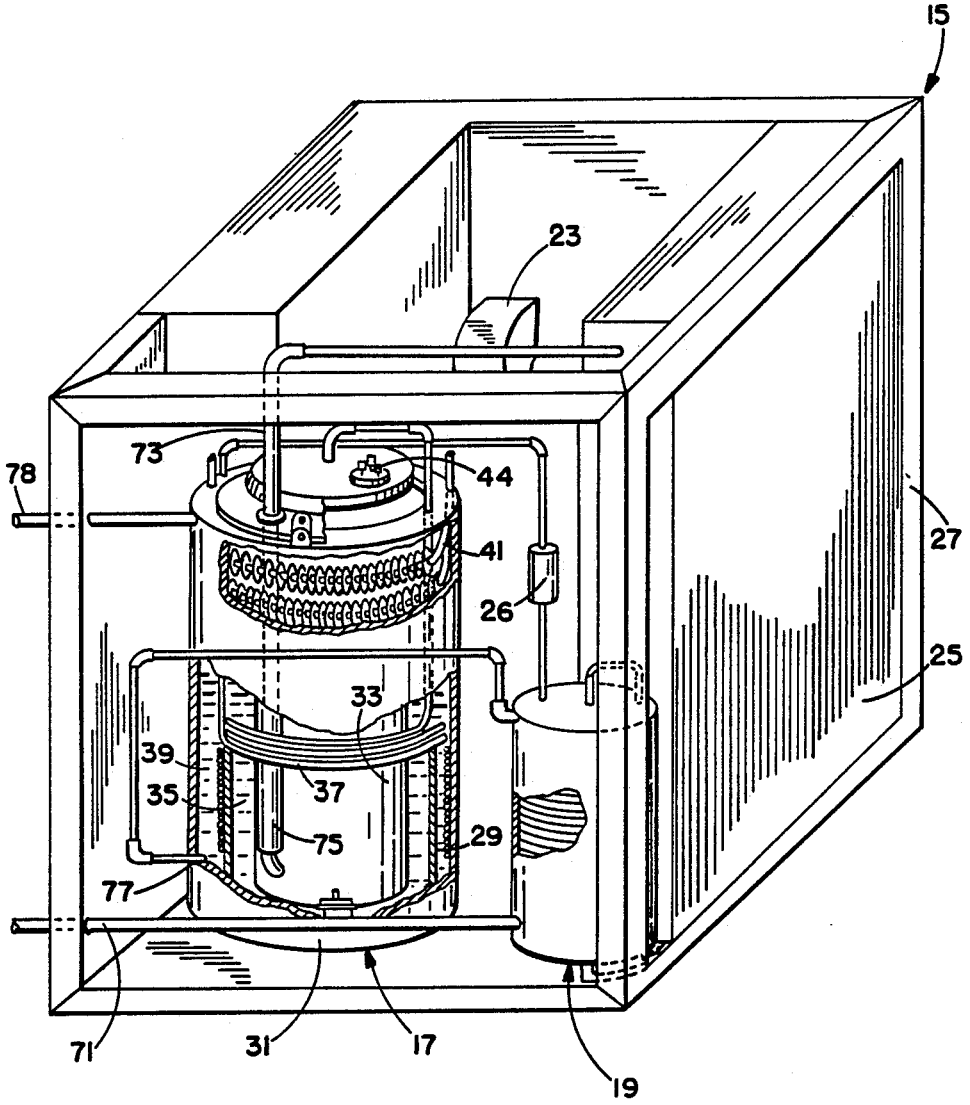
FIG. 1 is a perspective view of a heat pump system made in accordance with the present invention with portions broken away to illustrate the various components thereof.

Referring to the drawings and initially to FIG. 1, there is illustrated a heat pump system 15 made in accordance with the present invention. Heat pump system 15 includes a compressor-condenser unit 17, a subcooler 19, a blower assembly 23 (partially illustrated), and an evaporator 25. Preferably, the refrigerant line running between the compressor-condenser unit 17 and the subcooler 19 includes a filter drier 26 which contains silica gels. The aforementioned components of system 15 are neatly consolidated within housing 27.

Figure 2:
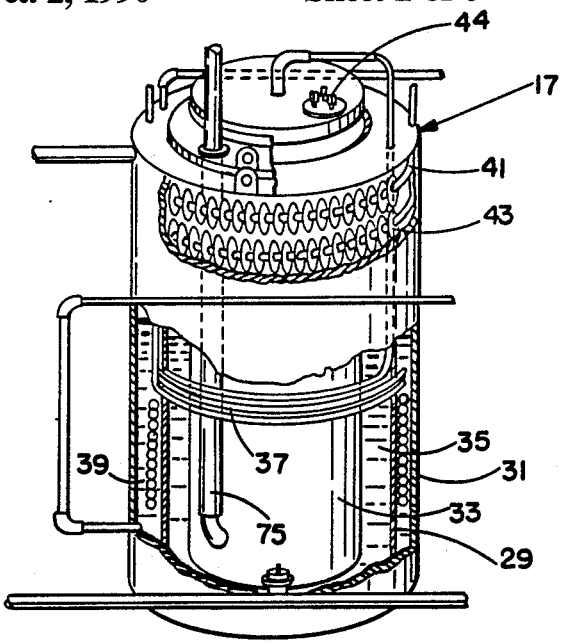
FIG. 2 is a perspective view partially broken away of the compressor-condenser unit of FIG. 1.
Figure 8:
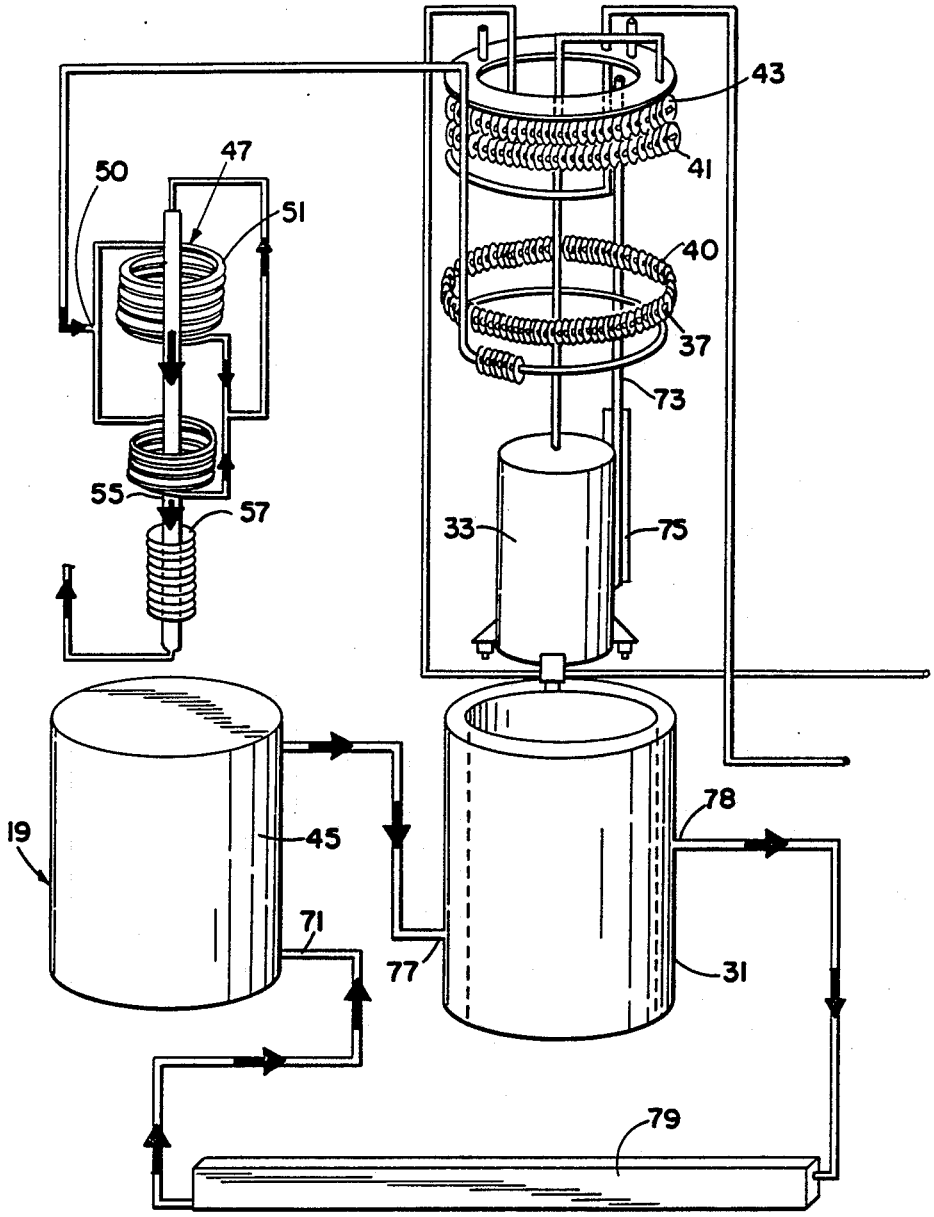
FIG. 8 is a schematic illustration of the heat pump system of FIG. 1.

Compressor-condenser unit 17, as more clearly shown in FIGS. 2 and 8, includes an inner tank 29 and an outer tank 31. Located within inner tank 29 is the motor-compressor 33 which is almost but not quite completely immersed within a liquid 35. Liquid 35 is static for it does not circulate within inner tank 31. Located in the cylindrical chamber between the inner tank 29 and the outer tank 31 is the condenser 37. Condenser 37 is immersed in circulating water 39 and thus heats water 39. Condenser 37 preferably includes a plurality of fins 40, which are not shown in FIGS. 1 and 2, but are shown in FIG. 8. Fins 40 enhance the transfer of heat from the refrigerant flowing within the condenser 37 to the circulating water 39. Immersed in circulating water 39 is a separate heat exchanger coil 41 for potable water which may be used, for example, for drinking, swimming or the like. Generally, commercial standards require that potable water be isolated from tubes containing regrigerant such as the tubes which form condenser 37. Heat exchanger coil 41 also preferably includes a plurality of metal fins 43 which enhance the transfer of heat from the circulating water 39 to the potable water flowing therein.

Immersion of the motor-compressor 33 in liquid 35 results in the motor-compressor 33 operating at lower temperatures because it allows heat from the motor-compressor 33 to flow to the circulating water 39. Generally, the lower the operating temperature of the motor-compressor 33 the greater the efficiency of the system 15.

Preferably, liquid 35 comprises water for water exhibits a high coefficient of thermal conductivity. Specifically, the liquid 35 may be distilled or specially treated water. However, any one of a variety of other liquids may be utilized, for example, glycol, oil, or the like. Because the motor-compressor 33 is isolated from the circulating water 39 and the liquid 35 in the inner tank 29 is static, the outer housing of the motor-compressor 33 is not subject to the ravages of whatever may be in solution in the circulating water.

Incomplete immersion of the motor-compressor 33 provides various advantages over the prior art method of total immersion. Specifically, incomplete immersion eliminates the possibility of the liquid 35 contaminating the electrical connections 44. Additionally, circulating water 39 may be pressurized without presenting any danger to electrical connections 44. Incomplete immersion also facilitates repair and replacement of the motor-compressor 33 resulting in excess of an 80% (1 hour versus 5 to 6 hours) service time savings for changing the mostly immersed motor-compressor 33 as compared to prior art systems where the motor-compressor is fully immersed. Moreover, the static liquid does not have to be drained and replaced. Systems having incompletely immersed motor-compressors are also easier to fabricate than conventional systems having fully immersed motor-compressors.

Figure 6:
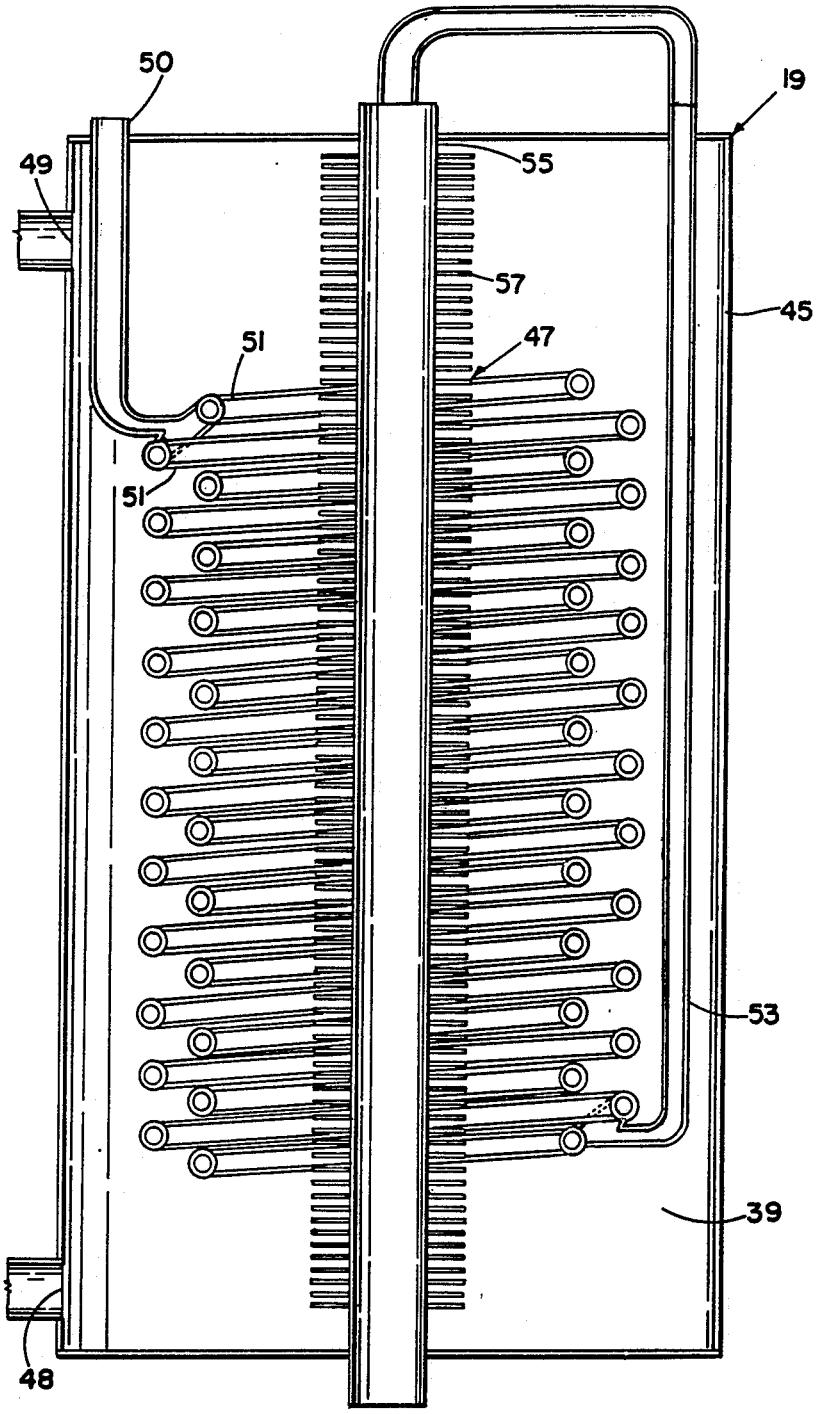
FIG. 6 is a cross-sectional view of the subcooler of FIG. 1.
Figure 7:
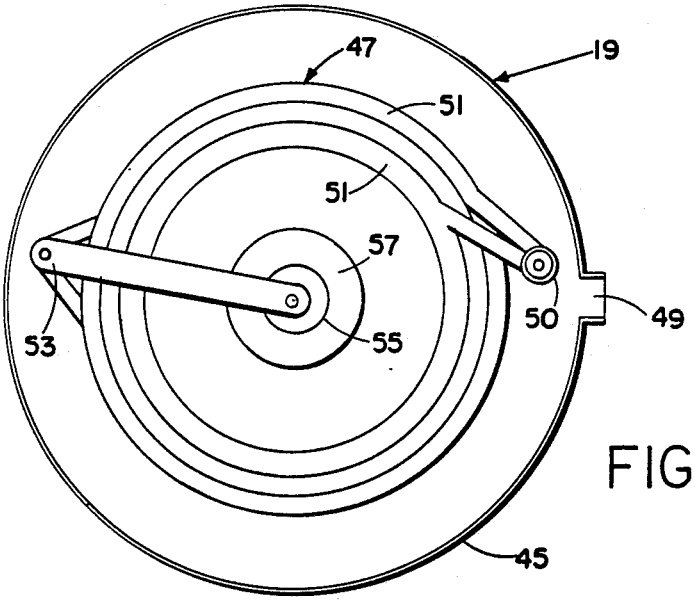
FIG. 7 is a top plan view of the subcooler of FIG. 6 with the top thereof removed.

Subcooler 19, as shown in FIGS. 6–8, includes a tank 45 which contains the circulating water 39 before it enters the outer tank 31 and a subcooling coil 47. Circulating water enters the bottom of tank 45 at inlet 48 and exits the top of tank 45 at outlet 49. Subcooling coil 47 comprises a refrigerant input tube 50 which branches into a pair of tubes 51 connected in parallel. By providing a pair of tubes 51 there is twice the surface area for the same mass flow that would be provided with a single tube having twice the diameter. This increase in surface area enhances the transfer of heat between the refrigerant flowing within tubes 51 and the circulating water 39.

Tubes 51 are coiled in a helical fashion and extend throughout the length of the subcooler 19 and are joined at their ends to tube 53 which directs the flow of refrigerant to tube 55. Tube 55 extends vertically through the center of the helix formed by tubes 51 and includes a plurality of fins 57. Fins 57 further enhance the transfer of heat from the refrigerant to the circulating water 39.

In a typical heat pump system the refrigerant flows through tubes 51 at a temperature of about 130° F. to 160° F. depending upon the particular application or desired water temperature. Generally, if system 15 is utilized to heat water, for example, for a swimming pool, the temperature of the circulating water 39 in the subcooler 19 would be lower than if the circulating water 39 in system 15 were utilized to heat, for example, water for domestic heating. The higher the temperature of the refrigerant flowing in the subcooling coil 47, the more likely solids or minerals in the circulating water 39 surrounding the subcooling coil 47 are to go out of solution and adhere to the subcooling coil 47 and thermally insulate the coil. Deposits are more likely to be detrimental to finned tubes than they are to plain tubes because the space between the fins will eventually close rendering the fins useless. Thus, in order to prevent the clogging of the fins 57 of tube 55, the refrigerant is first cooled in plain tubes 51. After the refrigerant has passed through plain tubes 51 and lost a lot of its heat it then flows through the finned tube 55. Since the refrigerant is at a lower temperature when it enters finned tube 55 there is less of a chance of deposits forming on fins 57 thus resulting in optimum heat exchange.

Preferably, all of the tubes in the system 15 which are immersed in liquid or water and which serve to transfer heat such as tubes 51 and 55 are coated with PTFE (polytetrafluoroethylene). PTFE serves as an antistick coating which helps to keep the fins and tubes free of deposits.

In the illustrated embodiment of FIG. 1 the heat pump system 15 is utilized to generate hot water. As schematically illustrated in FIG. 8 the cool water or circulating water 39 enters through input line 71 which directs the circulating water 39 to subcooler 19. Subcooler 19 serves to subcool the refrigerant before it enters the evaporator 25 resulting in a net refrigeration gain which increases the capacity of the system.

In the prior art is has been the practice to superheat the returning refrigerant gas or vapor from the evaporator by running it in thermal contact with the hot refrigerant in the condenser. Applicant has found this to be a disadvantage because the capacity of the compressor is reduced and the heat lost from the hot liquid refrigerant to the suction gas from the evaporator is still in the system. The only advantage gained is the fact that the liquid refrigerant in the condenser has been slightly cooled. To the contrary, applicant's subcooler 19 results in a net refrigeration gain and increases the capacity of the system. These gains are the result of the liquid refrigerant cooling outside of the evaporator 25. When the liquid refrigerant is cooled outside the evaporator 25 less of the latent heat of evaporation is used up in cooling the liquid refrigerant to the evaporation temperature.

The standard cycle for considering this resultant benefit assumes, for example, that the liquid refrigerant is subcooled 9° F. from 86° F. to 77° F. In calculating the effect of the heat content of the saturated liquid refrigerant at 77° F., the pressure on the liquid refrigeramt is still the vapor pressure of the liquid refrigerant at 86° F. and is thus higher than the vapor pressure at 77° F. However, the effect on the heat content of the higher pressure is so small that it is negligible.

The net refrigerating effect can be calculated as follows. Subtract the enthalpy of the liquid refrigerant entering the evaporator at 77° F. from the enthalpy of the vaporized refrigerant leaving the evaporator at 5° F.

| | |
|---|---|
| 77.81 | BTU/lb vapor at 5° F. |
| −25.67 | BTU/lb liquid at 77° F. |
| =52.14 | BTU/lb net refrigerating effect |

Subtract the enthalpy of the liquid refrigerant entering the evaporator at 86° F. (in the absence of subcooling) from the enthalpy of the vaporized refrigerant leaving the evaporator at 5° F.

| | |
|---|---|
| 77.81 | BTU/lb vapor at 5° F. |
| 27.77 | BTU/lb liquid at 86° F. |
| =50.04 | BTU/lb net refrigeration effect |

Thus, the increase in capacity as a result of subcooling is 52.14 BTU/lb − 50.14 BTU/lb = 2.1 BTU/lb or $$\frac{2.1\ \text{BTU/lb}}{50.04\ \text{BTU/lb}} \times 100 = 4.2\%$$

Therefore, by employing the subcooler 19 at 4.2% improvement may be experienced. This represents a 4.2% improvement in the efficiency and the capacity of the system. This improvement may be achieved by utilizing the circulating water 39 as illustrated, or in the proper environment, air. It will be appreciated that in certain applications where water from, for example, city water mains is available and enters the subcooler 19 at approximately 40° F., a 110° F. subcooling effect may result. Utilizing the 4.2% increase in efficiency calculated above (i.e., 9° F. of subcooling=4.2% increase in efficiency), then 110° F. of subcooling results in a 51% increase in efficiency.

As discussed above, the super heating of the refrigerant reduces the capacity of the compressor 33. Thus, the tube 73 which takes the return refrigerant to the compressor 33 preferably includes insulation 75 as clearly shown in FIG. 8 to prevent the static liquid 35 in tank 29, which is generally at about 160° F., from imparting significant heat into the refrigerant.

After the circulating water enters the input line 71 and is partially heated in the subcooler 19 it then flows into the bottom of outer tank 31 at 77. The circulating water is then further heated as it passes over condenser 37. As the circulating water 39 flows up through tank 31 it imparts heat into coil 41 and then flows out tube 78 for use in a heat exchanger, pool, or similar heat load 79.

As shown in FIG. 1, the refrigerant which is subcooled in subcooler 19 flows to the evaporator 25 and surrenders additional heat to the air which is blown through the evaporator 25 by blower 23. Thus, in addition to providing heated water, system 15 also provides air conditioned or cool air which may be utilized for example, to cool a house or a building.

In addition to water and air, it will be appreciated that a small amount of refrigerant may be vaporized to provide the necessary subcooling of the refrigerant flowing in the subcooler 19. However, when the refrigerant is cooled in this manner the capacity increase of the system is less due to the slightly higher volume of the refrigerant which results from vaporization.

Figure 12:
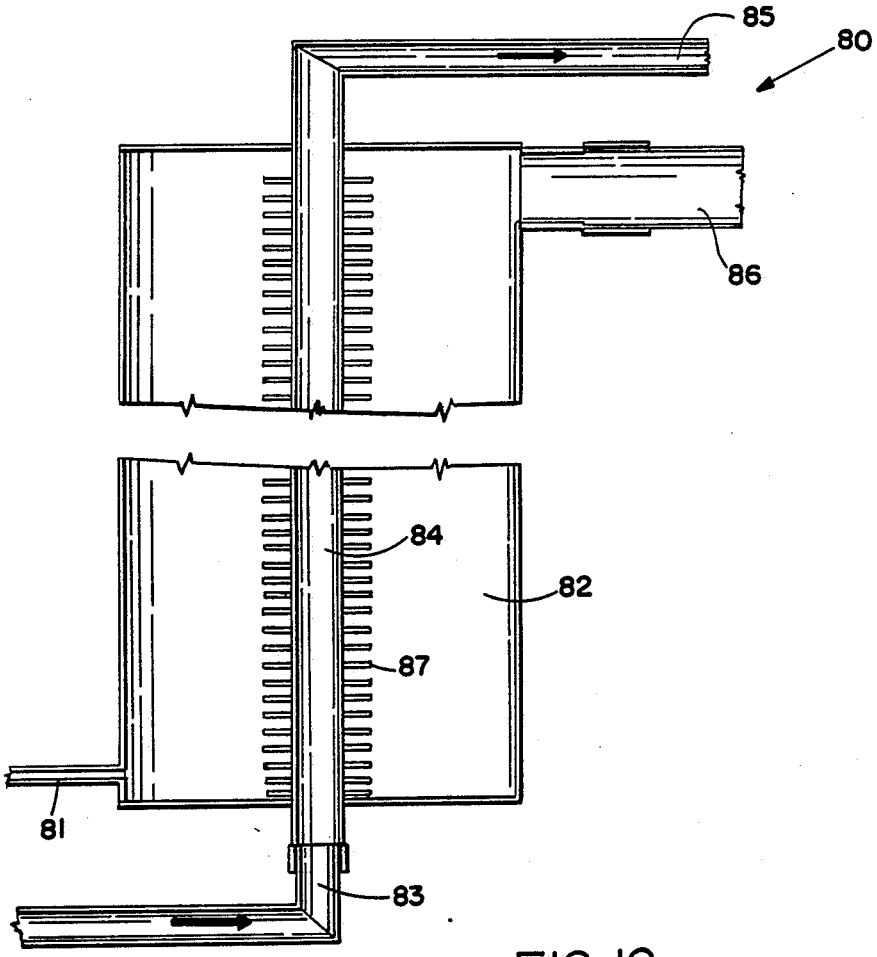
FIG. 12 is a cross-sectional view of another embodiment of a subcooler unit made in accordance with the present invention.

Referring now to FIG. 12 there is illustrated a subcooler unit 80 which utilizes a small amount of vaporized refrigerant to subcool the major flow of liquid refrigerant flowing through the subcooler unit 80 from the condenser and to the evaporator.

In some applications it is not desirable to use the circulating water in a system which, for example, heats water or air, because in the hot water system for instance, the water returning to be reheated would not be cool enough to be of real value to subcool the liquid refrigerant. Subcooler unit 80 rectifies this problem for it utilizes a small amount of vaporized refrigerant to subcool.

Subcooler unit 80 functions by directing a small amount of liquid refrigerant from the condenser through capillary tube 81. Preferably, the length of the capillary tube 81 will be such to produce an evaporating temperature within chamber 82 of about 20° F. The liquid refrigerant flows in line 83 from the condenser, through finned tube 84, and out through line 85 to the evaporator. The vaporized refrigerant flowing in from capillary tube 81 flows out suction line 86 after the vaporized refrigerant has taken heat from the finned tube 84 and the liquid refrigerant flowing therein which is generally at about 150° F. The suction line 86 is preferably connected into the suction line that returns to the compressor. The negative pressure desired in the chamber 82 can be controlled by the length of the capillary tube 81 or by a valve on the suction line 86.

Preferably, the fins 87 on finned tube 84 are at least eight per inch and have a diameter of at least about ¾ of an inch assuming the plain portion of finned tube 84 is about ⅜ of an inch in diameter. As the surface area of the finned tube 84 which carries the liquid refrigerant is of vital importance for losing heat to the vaporized refrigerant in chamber 82, the number of fins 87 is also important. In certain applications the number of fins 87 may have to be increased and they may also have to be crimped.

Figure 3:
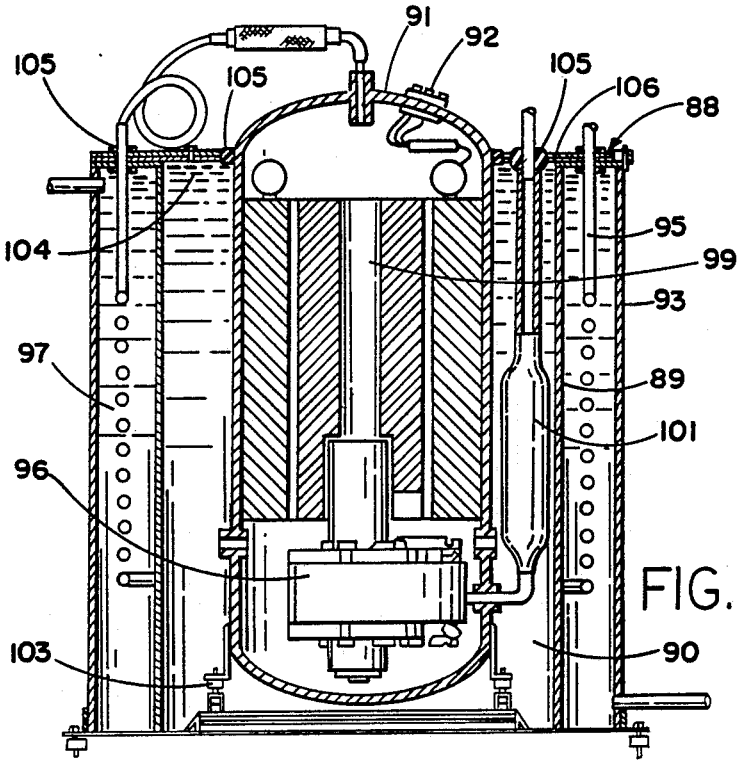
FIG. 3 is a sectional view of an alternative embodiment of a compressor-condenser unit made in accordance with the present invention and suitable for use in the system of FIG. 1.

Referring now to FIG. 3 there is illustrated another embodiment of a compressor-condenser unit 88 which is suitable for use in system 15. Like the compressor-condenser unit 17 illustrated in FIG. 2, compressor-condenser unit 88 includes an inner tank 89 which is filled with a liquid heat transfer medium 90 such as water or the like. Preferably, liquid 90 is water. Mostly immersed in the water 90 is the motor-compressor 91. Only the top dome of the sealed motor-compressor 91 which includes the electrical connections 92 is not immersed or exposed. Surrounding the inner tank 89 is the outer tank 93. Disposed between the inner tank 89 and outer tank 93 is the condenser 95 which is immersed in the circulating water 97.

Motor-compressor unit 91 provides a distinct advantage because it includes a rotary pump 96. Rotary pump 96 is driven by electric motor 99. The rotary pump 96 may employ either a fixed or a rotating vane. An example of a motor-compressor unit which utilizes a rotary pump and is suitable for use in the present invention is a fixed vane rotary compressor Model No. M63C602A sold by the Rotorex Company of Frederick, Md. A rotary pump provides various advantages because it is smaller, lighter, and smoother running than a comparable conventional reciprocating pump. Additionally, a rotary pump has only three basic moving parts and is thus simpler and more dependable than a conventional reciprocating pump.

In order to ensure the smooth operation of rotary pump 96 an accumulator 101 in some circumstances may be provided. Accumulator 101 provides a constant flow of refrigerant and lubrication oil to the rotary pump 96. But only in an application where the load is vastly variable should accumulator 101 be used, because its extra surface area increases the chance of superheating. Also, to minimize vibration preferably motor-compressor 91 is mounted within the base of the inner tank 89 utilizing bonded rubber mountings 103. Additionally, in order to prevent evaporation of the water 90, preferably there is provided about two inches of oil 104 on top of the water 90. Also, preferably a rust inhibitor is used in water 90 to prevent rusting of the motor-compressor 91 and other metal components. Soft compressible rubber seals 105 are provided within the top 106 of the compressor-condenser unit 88 where the motor-compressor 91 and various refrigerant tubes extend therethrough. Seals 105 prevent the escape and evaporation of the static water 90 and circulating water 97 and prevent the motor-compressor 91 from twisting with the starting torque which may cause work hardening of the tubing and fracture.

Figure 4:
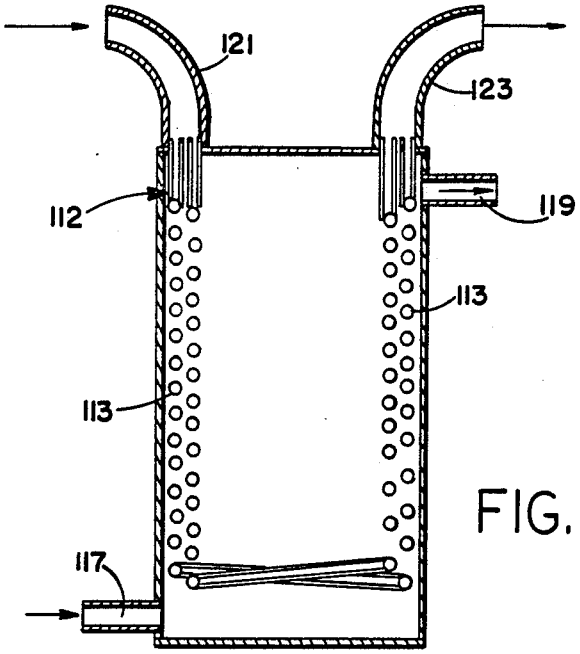
FIG. 4 is a cross-sectional view of another embodiment of a subcooler unit made in accordance with the present invention.

Referring now to FIG. 4 there is illustrated another embodiment of a subcooler 111 which is suitable for use in the present invention. Like the subcooler 19 discussed above, subcooler 111 includes a subcooling coil 112 having a pair of parallel helically wound tubes 113, a circulating water intake line 117 and output line 119, and a refrigerant input line 121 and output line 123.

Figure 10:
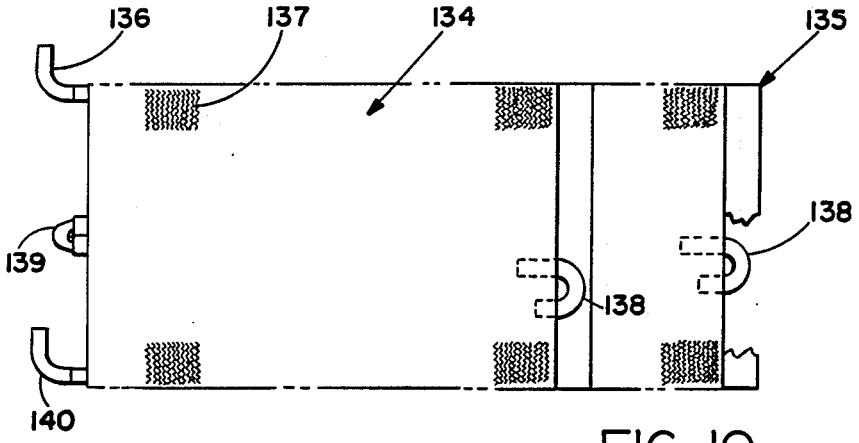
FIG. 10 is a side view of a coil suitable for use in constructing a condenser made in accordance with the present invention.
Figure 11:
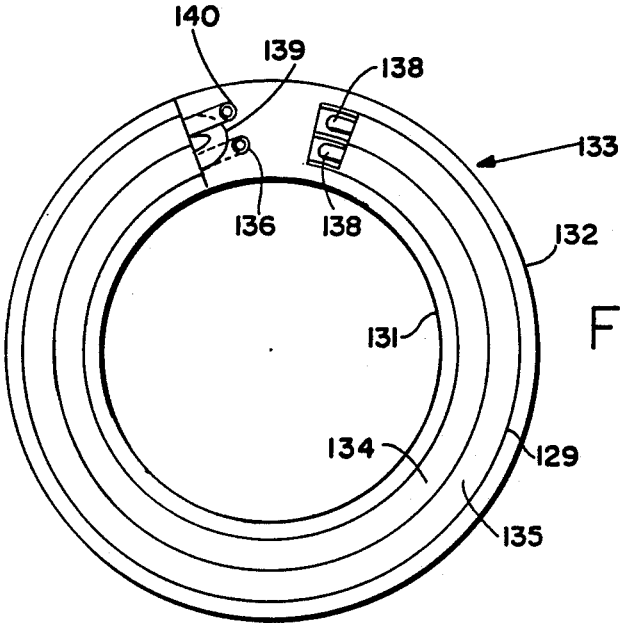
FIG. 11 is a top plan view of the coil of FIG. 10 after it has been formed and placed within the outer tank and inner tank of a compressor-condenser unit.

Referring now to FIGS. 10 and 11, and initially to FIG. 11, there is illustrated a condenser coil 129 suitable for use with the present invention. Condenser coil 129 comprises a pair of initially straight finned coils of different length which are circularized so as to allow condenser coil 129 to fit within the chamber 130 between the inner tank 131 and outer tank 132 of a compressor-condenser unit 133 (which is not fully illustrated). Coil 129 is produced by taking a standard heat exchanger coil 134 of one size and standard heat exchanger coil 135 of a larger size and connecting the two coils. The longer coil 135 is placed on the outside such that when the coils are circularized they will both be of the same circumferential extent. The serpentine tubing within the coil includes an inlet 136 passing through fins 137 and at the right hand side of FIG. 10 the tubing is bent to the U-shape indicated at 138 to extend back through the same heat exchange coil while at the opposite end the tubing includes cross-over bends 139 so that the tubing runs continuously through both exchangers from the inlet 136 to outlet 140.

Figure 9:
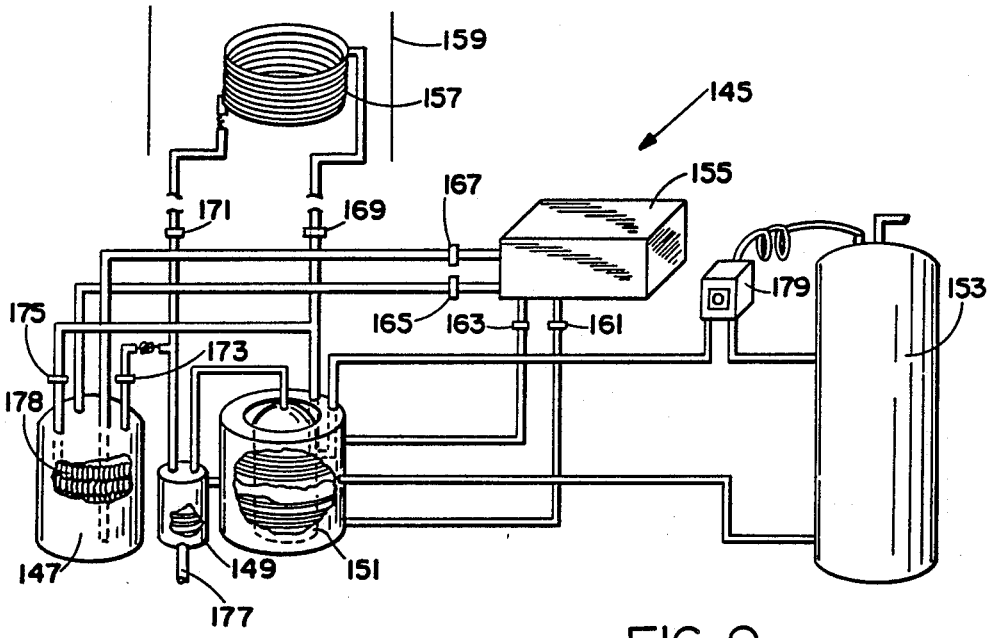
FIG. 9 is a schematic illustration of the heat pump system partially illustrated in FIG. 5.

Referring now to FIG. 9 there is schematically illustrated a heat pump system 145 made in accordance with the present invention which may be easily switched from a heating mode to a cooling mode. System 145 includes an evaporator unit 147, a subcooler 149, a compressor-condenser unit 151, a hot water storage tank 153, a heating and cooling unit 155, and an evaporator coil 157 located within a heated discharge vent 159. Vent 159 emanates from, for example, a kitchen and serves as a source of low grade waste heat when system 145 is in the heating mode.

System 145 also includes a plurality of valves to control the flow of refrigerant and circulating water so as to allow system 145 to be alternately switched between a heating and a cooling mode. Specifically, valves 161 and 163 control the flow of circulating water between the heating and cooling unit 155 and compressor-condenser unit 151. Valves 165 and 167 control the flow of circulating water between heating and cooling unit 155 and the evaporator unit 147. Valves 169 and 171 control the flow of refrigerant between the compressor-condenser unit 151 and the evaporator coil 157 and valves 173 and 175 control the flow of refrigerant between the evaporator unit 147 and compressor-condenser unit 151.

In both the heating and cooling mode cool circulating water, for example, from a water main, enters the subcooler 149 through line 177. The water is preheated in the subcooler 149 and then flows to the compressor-condenser unit 151. The water picks up heat from the compressor-condenser unit 151 and then flows to hot water tank 153 for storage and subsequent use.

In the heating mode valves 163 and 161 open to allow the heated water to flow to the heating and cooling unit 155 which contains a heat exchanger to allow heat to be transferred from the water to, for example, ambient air which is blown through the heating and cooling unit 155 and used to heat a room. In this mode valves 171 and 169 are open to allow refrigerant to flow to evaporator coil 157 which derives waste heat from the kitchen vent 159. Valves 175 and 173 are closed to prevent refrigerant flow to evaporator unit 147. Likewise, valves 165 and 167 are closed to prevent the flow of water or like liquid heat conducting medium to the heating and cooling unit 155.

In the cooling mode, valves 161 and 163 are closed to prevent the flow of heated water to the heating and cooling unit 155. Valves 169 and 171 are also closed to prevent the flow of refrigerant from the compressor-condenser unit 151 to the evaporator coil 157. Valves 175 and 173 are open to allow the flow of refrigerant to evaporator unit 147. Valves 165 and 167 are also open to allow the flow of water or like liquid heat conducting medium to the heating and cooling unit 155. In this mode the heating and cooling unit 155 circulates water on a closed loop to evaporator unit 147 having a finned evaporator coil 178 and the refrigerant flowing in the evaporator coil 178 withdraws heat from the water or other liquid flowing in the closed loop. This cool water or liquid then flows to the heating and cooling unit 155 where ambient air is passed through the heat exchanger to create cooled air for conditioning a room.

Preferably, as illustrated system 145 includes a temperature controlled blow off unit 179 which senses the temperature of the water in tank 153 and provides for the recirculation of the water in the tank for reheating by the compressor-condenser unit 151.

Figure 5:
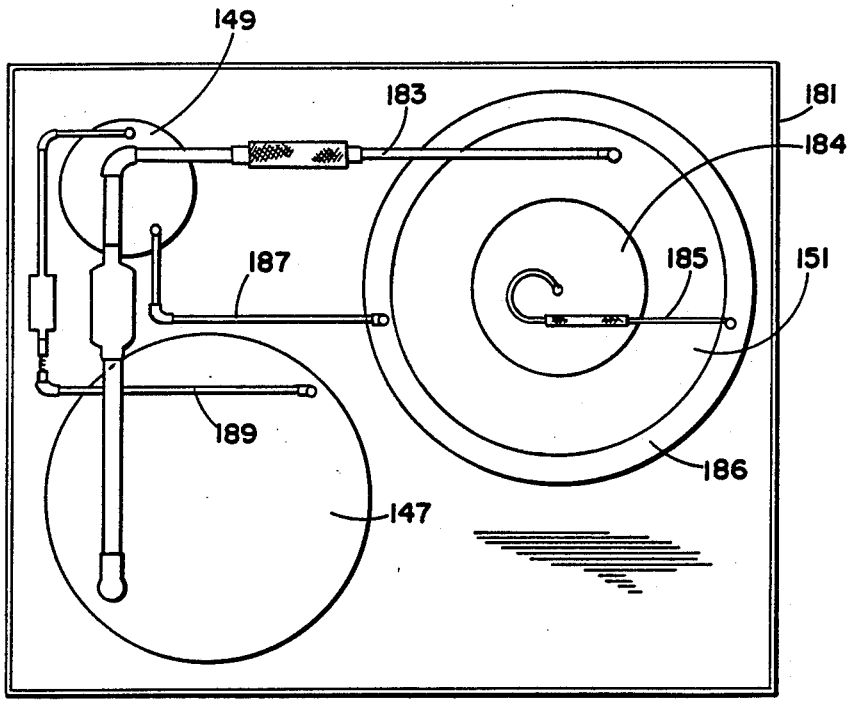
FIG. 5 is a top plan view of a portion of another embodiment of a heat pump system made in accordance with the present invention.

Referring now to FIG. 5, the compressor-condenser 151, subcooler 149 and evaporator unit are shown in a preferred arrangement wherein they are neatly contained within housing 181 in a very compact fashion. Also shown is some of the associated refrigerant piping. Specifically, illustrated is the suction line 183 running between the motor-compressor 184 of the compressor-condenser unit 151, the liquid refrigerant line 185 running between the motor-compressor 184 and the condenser 186, the liquid refrigerant line 187 running between the condenser 186 and the subcooler 149, and the liquid refrigerant line 189 between the subcooler 149 and the evaporator unit 147.

Although in the previously described embodiments of the invention circulating water has been utilized to withdraw heat from the condenser, it will be appreciated that depending upon the particular application any one of a variety of liquids may be used in conjunction with the present invention such as eutectic salts, glycol, oil, or the like. Also, it will be appreciated that the various components of a heat pump system made in accordance with the present invention may be constructed of various materials. Preferably, however, all refrigerant tubing is constructed of copper or aluminum so as to ensure maximum heat transfer and all structural components such as the inner and outer tanks are constructed of stainless steel so as to ensure superior structural integrity and resistance to corrosion.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

I claim:

1. A heat pump installation comprising refrigerant, a condenser, a motor-compressor, an evaporator, and a subcooler to subcool the refrigerant flowing from said condenser before it enters said evaporator so as to increase the efficiency of the installation and wherein said subcooler includes a housing containing a circulating liquid medium and a subcooling coil through which said refrigerant flows immersed in said circulating liquid, said subcooling coil including an inlet tube, a first portion, a second portion, and an outlet tube, said first portion comprising a pair of tubes extending essentially parallel to one another and connected at one common end to said inlet tube and connected at the other common end to said second portion, said second portion including multiple fins to maximize the transfer of heat from said refrigerant flowing therein.

2. A heat pump installation as set forth in claim 1 wherein said first portion comprises plain tubing without fins and is shaped into a cylindrical helix and further wherein said second portion includes a straight portion of tubing extending along the central axis of the helix formed by said first portion, said straight portion connected at one end to said first portion and connected at the other end to said outlet tube.

3. A subcooler for use in conjunction with a heat pump system comprising refrigerant, a compressor, condenser, evaporator, and a circulating liquid, said subcooler serving to subcool refrigerant flowing from such condenser before it enters such evaporator so as to increase the efficiency of such heat pump system, said subcooler comprising a subcooling coil and housing for containing said subcooling coil and directing the flow of such liquid around and about said subcooling coil, said subcooling coil comprising a length of tubing wrapped upon itself in an overlapping helical fashion and wherein said subcooling coil comprises an inlet tube, a first portion, a second portion and an outlet tube, said first portion of said subcooling coil comprising a pair of plain tubes connected at one common end to said inlet tube and at the other common end to said second portion, said second portion of said subcooling coil comprising fins.

4. A subcooler as set forth in claim 3 wherein said first portion is helical in shape.

* * * * *